US007750548B2

(12) United States Patent
Tamura et al.

(10) Patent No.: US 7,750,548 B2
(45) Date of Patent: Jul. 6, 2010

(54) IMAGE DISPLAY DEVICE

(75) Inventors: Takuo Tamura, Yokohama (JP); Masakazu Sagawa, Inagi (JP); Hiroshi Kikuchi, Zushi (JP)

(73) Assignee: Hitachi, Ltd., Tokyo (JP)

( * ) Notice: Subject to any disclaimer, the term of this patent is extended or adjusted under 35 U.S.C. 154(b) by 212 days.

(21) Appl. No.: 11/943,690

(22) Filed: Nov. 21, 2007

(65) Prior Publication Data

US 2008/0129187 A1 Jun. 5, 2008

(30) Foreign Application Priority Data

Nov. 24, 2006 (JP) ..... 2006-317350

(51) Int. Cl.
*H01J 1/62* (2006.01)

(52) U.S. Cl. ..... 313/495; 313/497

(58) Field of Classification Search ..... 313/495–497, 313/491, 506

See application file for complete search history.

(56) References Cited

FOREIGN PATENT DOCUMENTS

JP 07-065710 3/1995

OTHER PUBLICATIONS

K. Yokoo, et al., "Emission characteristics of metal-oxide-semiconductor electron tunneling cathode," J. Vac, Sci. Technol., B11(2), pp. 429-432 (1993).

N. Negishi, et al., "High Efficiency Electron-Emission in Pt/$SiO_x$/Si/Al Structure," Jpn. J. Appl. Phys., vol. 36, Part 2, No. 7B, pp. L939-L941 (1997).

S. Okamoto, "Electron emission from electroluminescent thin film—thin film cold electron emitter—" (in Japanese), Oyo Buturi (Applied Physics), vol. 63, No. 6, pp. 592-595 (1994).

N. Koshida, "Light emission from porous silicon—Beyond the indirect/direct transition regime—," (in Japanese), Oyo Buturi (Applied Physics), vol. 66, No. 5, pp. 437-443 (1997).

*Primary Examiner*—Vip Patel
(74) *Attorney, Agent, or Firm*—Antonelli, Terry, Stout & Kraus, LLP.

(57) ABSTRACT

An image display device in which each pixel has a thin-film electron source composed of a lower electrode (which is a signal wire), an electron accelerating layer (which is formed by anodizing the surface of said signal wire), and an upper electrode (which covers said electron accelerating layer and releases electrons), in which the anodized film constituting said electron accelerating layer contains hydrated alumina component and anhydrous alumina component such that their ratio in the side close to the upper electrode is greater than that in the side close to the lower electrode. This structure prevents said thin-film electron source from being deteriorated in diode characteristics by said electron accelerating layer, thereby enhancing the reliability of said image display device.

10 Claims, 20 Drawing Sheets

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

A-A' sectional view

B-B' sectional view

FIG.18

| AO film annealing temperature | Ratio of hydrate alumina | |
|---|---|---|
| | Upper layer | Lower layer |
| ①100℃ | 0.55 | 0.43 |
| ②150℃ | 0.45 | 0.38 |
| ③250℃ | 0.40 | 0.36 |
| ④350℃ | 0.36 | 0.33 |
| ⑤450℃ | 0.26 | 0.24 |

IMAGE DISPLAY DEVICE

The present application claims priority from Japanese application JP2006-317350 filed on Nov. 24, 2006, the content of which is hereby incorporated by reference into this application.

BACKGROUND OF THE INVENTION

1. Field of the Invention

The present invention relates to an image display device and, more particularly, to an image display device called flat panel display of selfluminous type with an array of thin-film electron sources.

2. Description of the Related Art

The thin-film electron source is basically composed of three thin films functioning as upper electrode, electron accelerating layer, and lower electrode, which are placed one over another. It emits electrons into a vacuum from the surface of the upper electrode upon application of a voltage across the upper electrode and the lower electrode.

The thin film electron source includes the following three types and others.

Metal-insulator-metal (MIM) type, composed of metal layer, insulator layer, and metal layer which are placed one over another.

Metal-insulator-semiconductor (MIS) type, composed of metal layer, insulator layer, and semiconductor layer which are placed one over another.

Metal-insulator-semiconductor-metal type, composed of metal layer, insulator layer, semiconductor layer, and metal layer which are placed one over another.

Their references are listed below.

Patent documents 1, 2, and 3 concerning the MIM type.

Non-patent document 1 concerning MIS type (for MOS).

Non-patent document 2 concerning metal-insulator-semiconductor-metal type (for HEED).

Non-patent document 3 concerning EL type.

Non-patent document 4 concerning porous-silicon type.

Patent document 1: Japanese Patent Laid-open No. Hei-7-56710

[Non-patent document 1] K. Yokoo, et al., "Emission characteristics of metal-oxide-semiconductor electron tunneling cathode," J. Vac, Sci. Technol., B11(2), pp. 429-432 (1993)

[Non-patent document 2] N. Negishi, et al., "High Efficiency Electron-Emission in Pt/$SiO_x$/Si/Al Structure," Jpn. J. Appl. Phys., vol 36, Part 2, No. 7B, pp. L939-L941 (1997)

[Non-patent document 3] S. Okamoto, "Electron emission from electroluminescent thin film—thin film cold electron emitter—" (in Japanese), OYO BUTURI (Applied Physics), vol. 63, No. 6, pages 592-595 (1994)

[Non-patent document 4] N. Koshida, "Light emission from porous silicon—Beyond the indirect/direct transition regime—," (in Japanese), OYO BUTURI (Applied Physics), vol. 66, No. 5, pages 437-443 (1997)

SUMMARY OF THE INVENTION

The image display device can be composed of an array of electron sources (in the form of matrix) and a phosphor placed thereon in a vacuum. The matrix has lines (of electron sources arranged in the horizontal direction) and columns (of electron sources arranged in the vertical direction). The phosphor is divided into a large number of sections corresponding to individual electron sources. The electron source of MIM type has a thin film as the electron accelerating layer, which is an anodized film (AO film) formed by anodizing aluminum (which is a lower electrode functioning as a signal wire) in an electrolyte. The anodized film inevitably captures water from the electrolyte, and water in the anodized film is detrimental to the characteristics of the electron source of MIM type which functions as a diode. The electron source with deteriorated characteristics makes the image display device poor in long-term reliability. Thus, the water content in the anodized film should be adequately controlled.

It is an object of the present invention to provide a highly reliable image display device in which the anodized film (as a constituent of the thin-film electron source) keeps its diode characteristics intact.

The image display device according to the present invention is based on the thin-film electron source represented by that of MIM type, in which the anodized film constituting the electron accelerating layer contains an adequately controlled amount of water to ensure high reliability.

BRIEF DESCRIPTION OF THE DRAWINGS

FIG. 18 is a diagram illustrating the effect of annealing temperature on the ratio of hydrated alumina in the alumina film. This result was obtained by the analyses shown in FIGS. 16 and 17.

DETAILED DESCRIPTION

The following is a detailed description of the preferred embodiment of the present invention in reference to the drawings illustrating an example. The example is an image display device with an electron source of MIM type. The present invention is applicable to any image display device having an electron source of MIM type or an electron source of thin-film type with an anodized layer. It is also applicable to any image display device having an electron source of surface conduction type or an electron source of hot electron type which has a thin electron emission electrode to emit only part of element current into a vacuum.

Example 1

Figure 1:
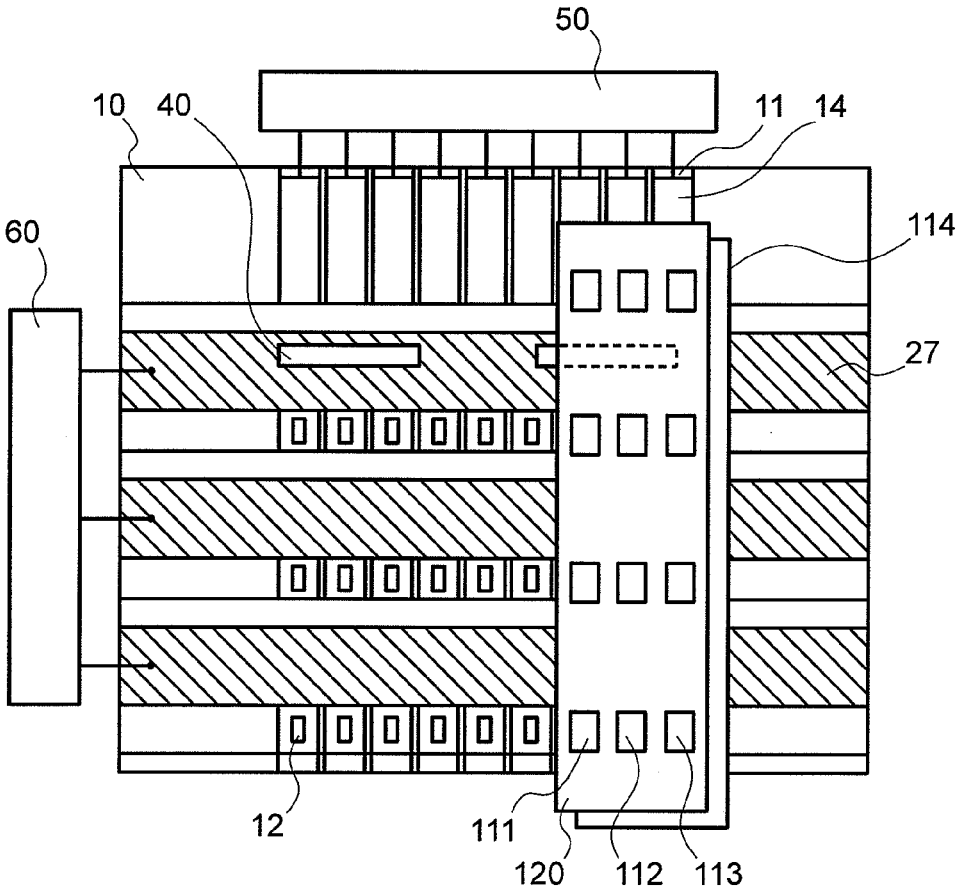
FIG. 1 is a schematic diagram illustrating the image display device according to Example 1 of the present invention.

FIG. 1 is a schematic diagram illustrating the image display device according to Example 1 of the present invention. The image display device is basically composed of a first substrate 10 on which the electron source is formed and a second substrate (not shown) on which a phosphor is partly formed. The first substrate, which is preferably a glass plate, is referred to as a cathode substrate or rear substrate, and the second substrate, which is preferably a glass plate, is referred to as a fluorescent substrate, display-side substrate, front substrate, or color-filter substrate. The second substrate has on its inner surface a black matrix 120 and three phosphors 111, 112, and 113 (red R, green G, and blue B) which are partly shown.

The rear substrate 10 has lower electrodes 11, scan wires 27, and other functional films (mentioned later) which are formed thereon. The lower electrodes 11 constitute signal wires (data wires) connecting to the signal wire drive circuit 50. The scan wires 27 connect to the scan wire drive circuit 60 and intersect with the signal wires at right angles. The cathode (as the thin-film electron source or electron emission part) is arranged within the width of the scan wire, so that electrons are emitted from the upper electrode 13 (not shown in FIG. 1 but mentioned later) through the electron accelerating layer (tunnel insulating layer) 12, which is formed in the upper electrode 13 formed on the lower electrode 14, with the insulating layer (so-called field insulating layer) 14 interposed between them and also in the thin part of the insulating layer 14.

Figure 2:
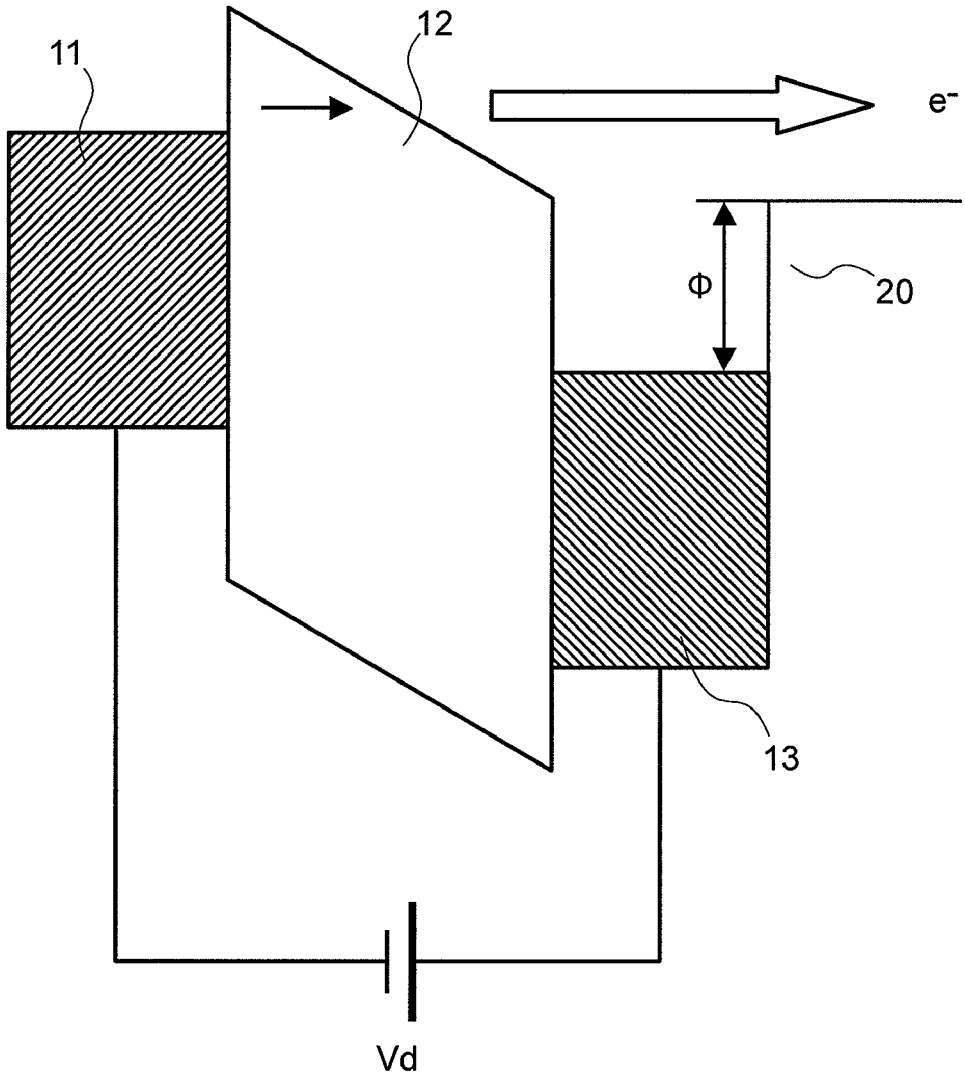
FIG. 2 is a diagram illustrating the principle of the electron source of MIM type.
Figure 3A:
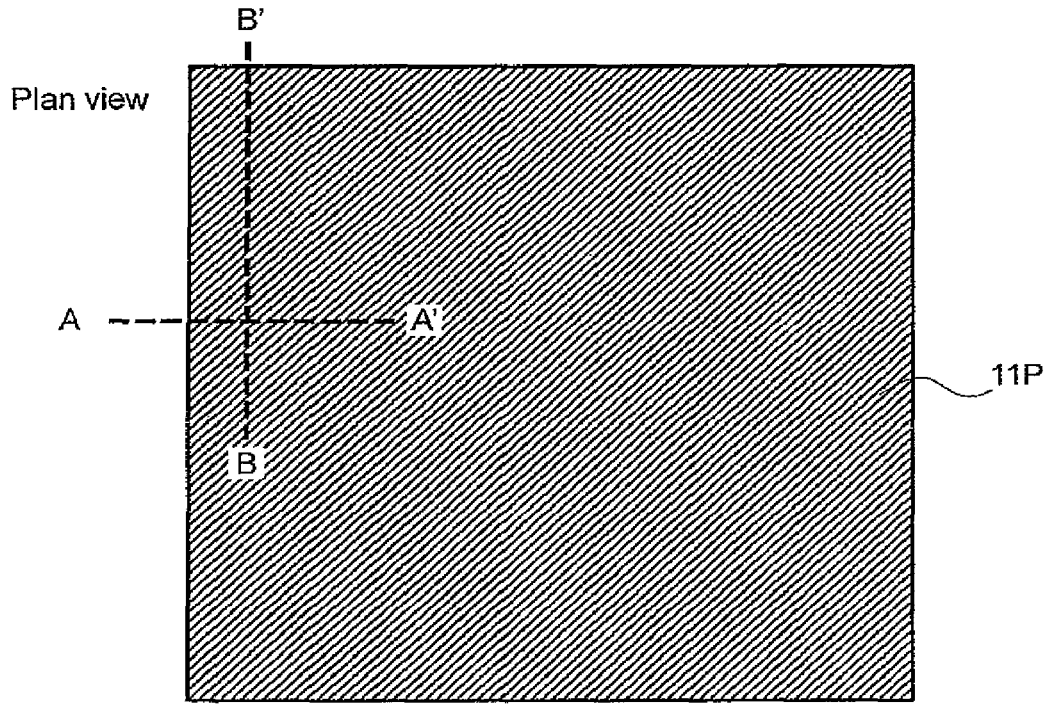
FIGS. 3A to 3C are diagrams showing the process for producing the thin-film electron source pertaining to the present invention.
Figure 3B:
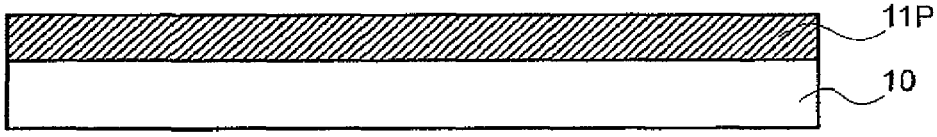
Figure 3C:
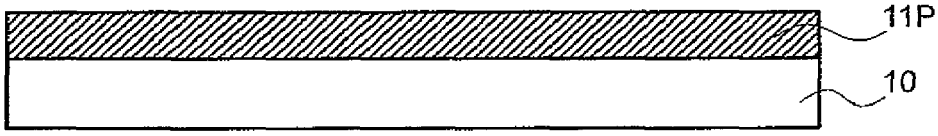

The electron source of MIM type, whose principle is illustrated in FIG. 2, works in the following way. It is composed of the upper electrode 13 and the lower electrode 11, with the electron accelerating layer (tunnel insulating layer) 12 interposed between them. A drive voltage Vd is applied across the upper electrode 13 and the lower electrode 11 so that there exists an electric field of about 1 to 10 MV/cm in the tunnel insulating layer 12. The electric field causes electrons close to the Fermi level in the lower electrode 11 to pass through the barrier by tunneling and enter the conduction band of the insulating layer 12 (as the electron accelerating layer). The electrons change into hot electrons, which subsequently enter the conduction band of the upper electrode 13. Of these hot electrons, those which have reached the surface of the upper electrode 13 while carrying an energy greater than the work function $\phi$ of the upper electrode 13 release themselves into the vacuum. The electron source of MIM type typically has the Au—$Sl_2O_3$—Al structure.

The front substrate, which is not shown in FIG. 1, has its inner surface covered with the black matrix 120 (or the shading layer to increase the contrast of the displayed image) and three phosphors 111 for red (R), 112 for green (G), and 113 for blue (B). The red phosphor is $Y_2O_2S$:Eu (p22-R), the green phosphor is ZnS:Cu,Al (p22-G), and the blue phosphor is ZnS:Ag,Cl (p22-B). The rear substrate 10 and the display side substrate are separated from each other by the spacer 40 that ensures a certain distance. The space between the two substrates is kept vacuous by the shielding frame (not shown) surrounding the periphery of the display region.

The spacer 40 is placed close to the upper side of the scan wire 27 formed on the rear substrate 10. (The upper side is opposite (in the direction in which the signal wire 11 extends) to the electron emission part arranged close to the lower side (in the widthwise direction) of the scan wire 27.) Also, the spacer 40 is so arranged as to hide itself under the black matrix 120 formed on the front substrate. The lower electrodes 11 (as signal wires) are connected to the signal wire drive circuit 50, and the scan electrodes 27 (as scan electrode wires) are connected to the scan wire drive circuit 60. For the array of thin-film electron sources to be applied to the image display device, it needs thin upper electrodes. Thus, the upper buss electrodes are provided for their power supply.

The following is a detailed description of the rear substrate 10 as a constituent of the image display device according to the present invention. The description references FIGS. 3A-3C and 11A-11C illustrating the process of production. Incidentally, FIGS. 3A-3C and 11A-11C respectively only show one full-color pixel (composed of red, green, and blue subpixels) in plan view and sectional views taken along the lines A-A' and B-B'.

The first step starts with coating the rear substrate 10 (of insulating material such as glass) with a metal film lip for the lower electrodes (signal wires) 11. The metal film lip is formed from aluminum (Al) or aluminum alloy (such as Al—Nd). Aluminum gives a high-quality insulating film upon anodization. The Al—Nd alloy is one which contains 2 at % Nd. Coating is accomplished by sputtering. The metal film lip has a thickness of 300 nm.

Figure 4A:
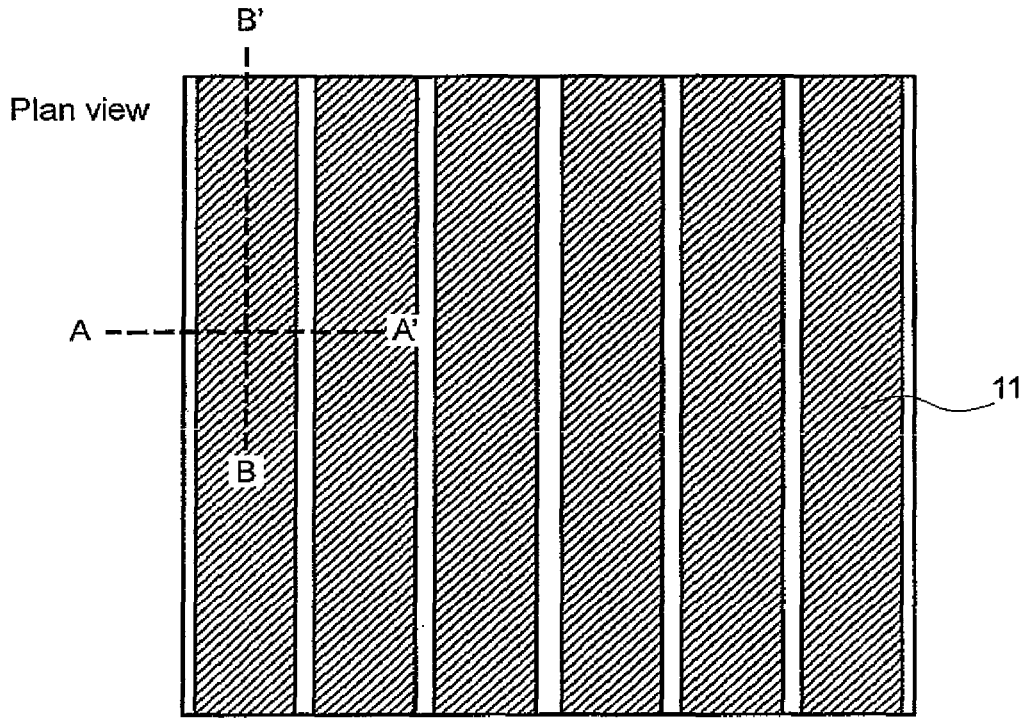
FIGS. 4A to 4C are diagrams showing the process (which follows the step shown in FIGS. 3A to 3C) for producing the thin-film electron source pertaining to the present invention.
Figure 4B:
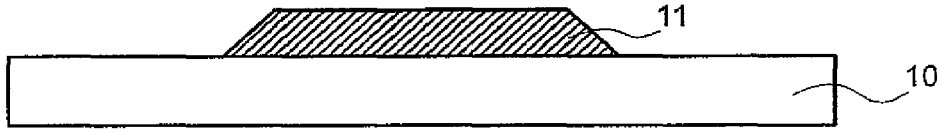
Figure 4C:
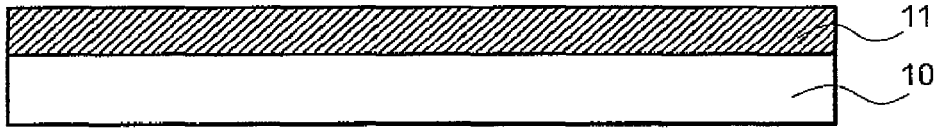

The metal film lip formed on the substrate undergoes patterning and etching to form the lower electrodes 11 in stripes. (FIGS. 4A to 4C) The lower electrodes 11 vary in width depending on the size and dissolution of the image display device. The ordinary width is about 100 to 200 μm, which corresponds to the pitch of the subpixel. Etching is accomplished by wet process with an aqueous solution of phosphoric acid, acetic acid, and nitric acid mixed together. The resist patterning may be accomplished by inexpensive printing or proximity printing because the electrodes are in wide simple stripes.

Figure 5A:
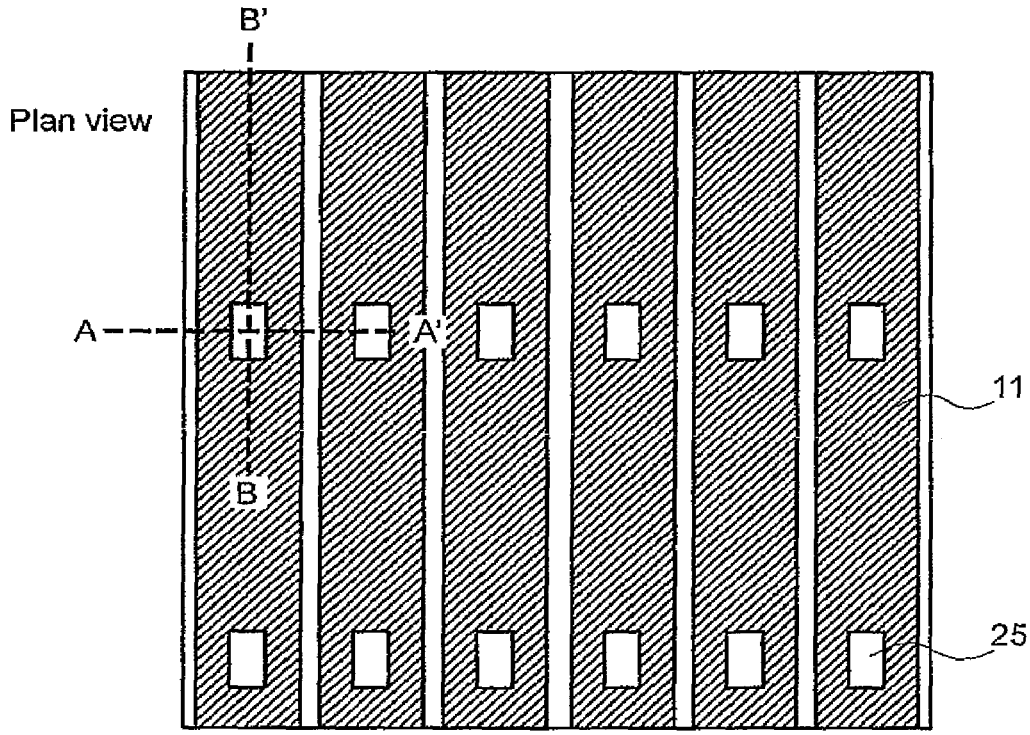
FIGS. 5A to 5C are diagrams showing the process (which follows the step shown in FIGS. 4A to 4C) for producing the thin-film electron source pertaining to the present invention.
Figure 5B:
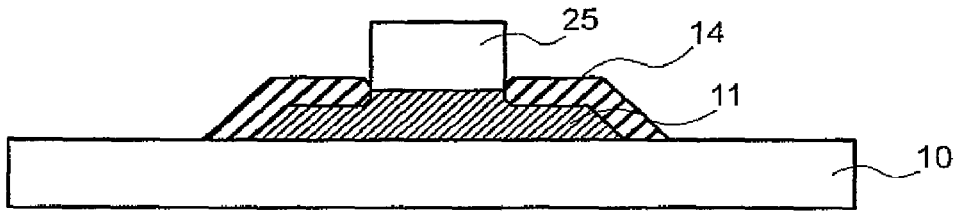
Figure 5C:
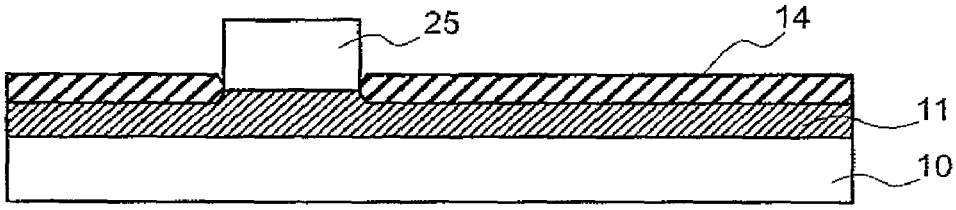
Figure 6A:
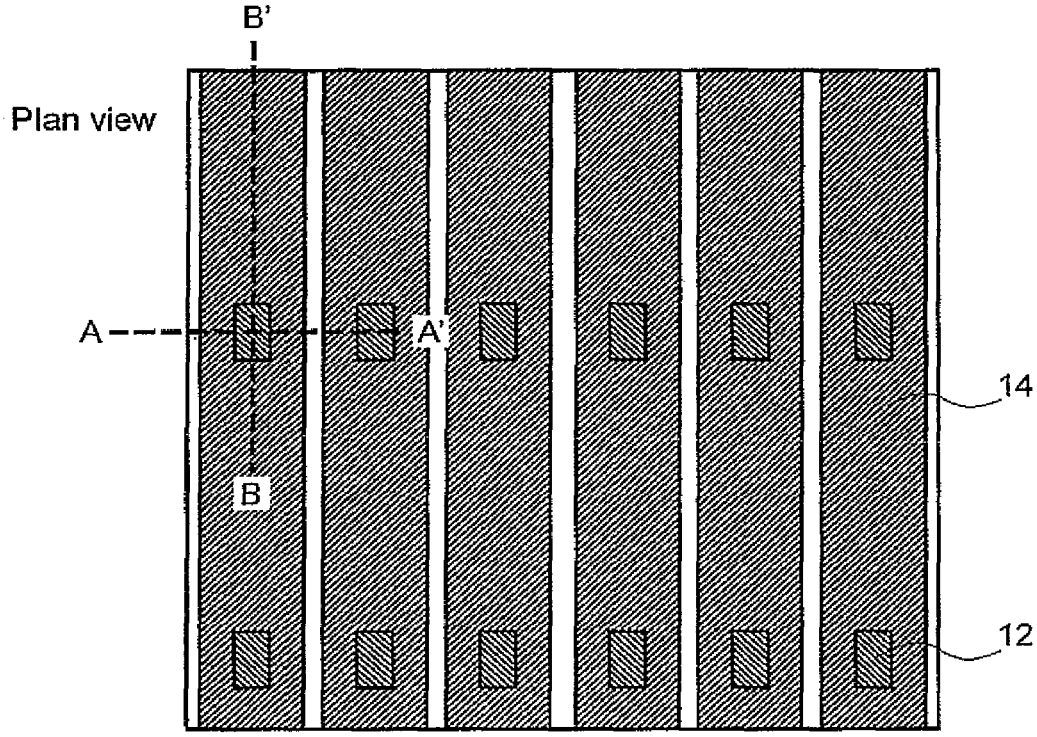
FIGS. 6A to 6C are diagrams showing the process (which follows the step shown in FIGS. 5A to 5C) for producing the thin-film electron source pertaining to the present invention.
Figure 6B:
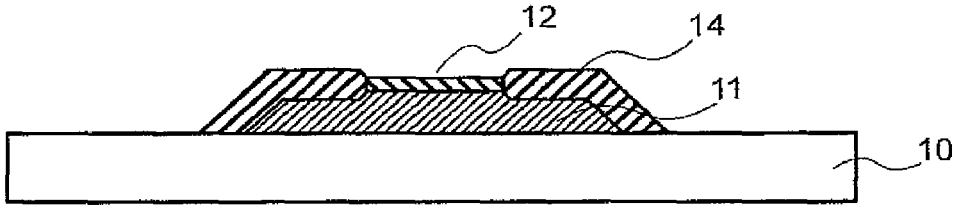
Figure 6C:
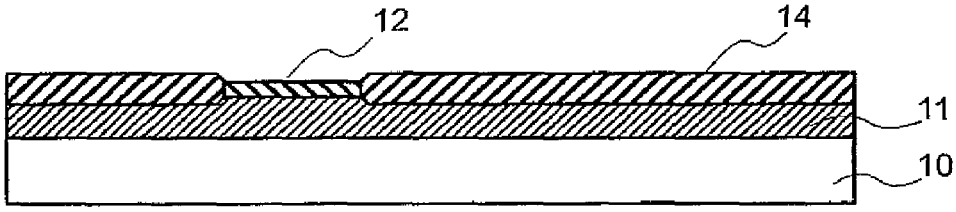

The next step is intended to form the protective insulating layer (field insulating layer) 14 (which prevents the electric field from concentrating at the edge of the lower electrode 11) and the tunnel insulating layer 12 on each of the lower electrodes 11. First, that part of the lower electrode 11 from which electrons are emitted is masked with the resist film 25, as shown in FIGS. 5A to 5C, and the other part of the lower electrode 11 is anodized selectively and thickly (by formation) to form the protective insulating layer 14. A formation voltage of 100 V is suitable for the protective insulating film 14 with a thickness of about 136 nm. Then, the resist film 25 is removed and the uncoated surface of the lower electrode 11 is anodized. A formation voltage of 6 V is suitable for the tunnel insulating layer (electron accelerating layer) 12, about 10 nm thick, to be formed on the lower electrode 11. (FIGS. 6A to 6C) Incidentally, although this example illustrates the electron accelerating layer with a thickness of about 10 nm, the layer thickness can be adjusted by changing the formation voltage. For the image display device with the electron source of MIM type according to this example, the layer thickness should be about 5 to 15 nm for the high light-emitting efficiency. The electron accelerating layer will have a thickness of 5 nm or 15 nm at a formation voltage of 3 V or 9 V, respectively.

The step of anodization is followed by heat treatment for desorption of water captured from the electrolyte during anodization. According to this example, the heat treatment (or annealing) is carried out sequentially in the atmosphere of air, vacuum, and nitrogen.

Figure 7A:
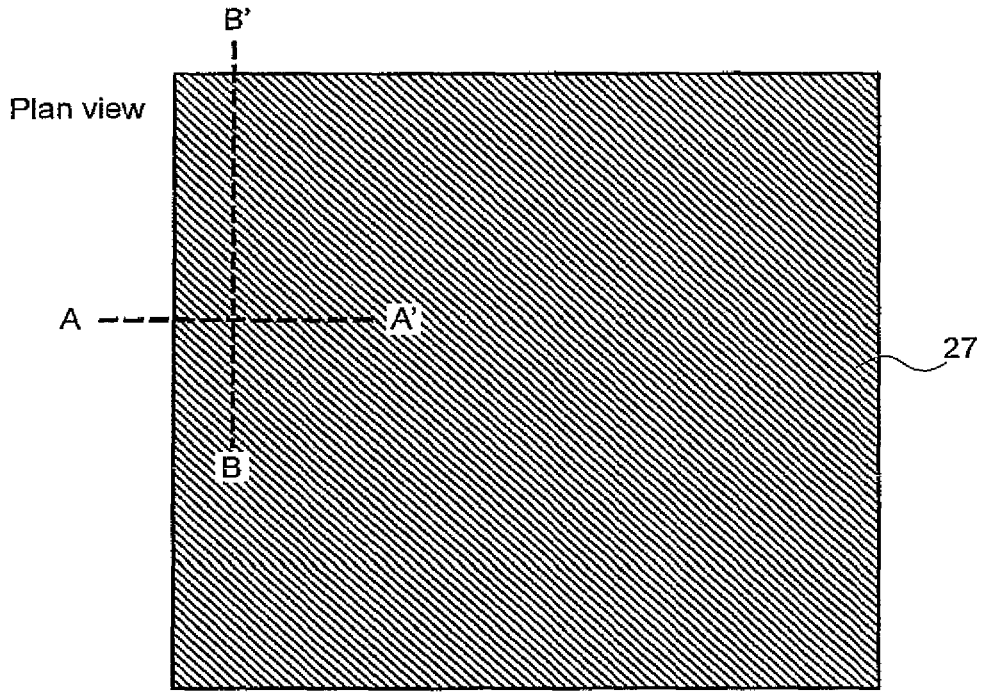
FIGS. 7A to 7C are diagrams showing the process (which follows the step shown in FIGS. 6A to 6C) for producing the thin-film electron source pertaining to the present invention.
Figure 7B:
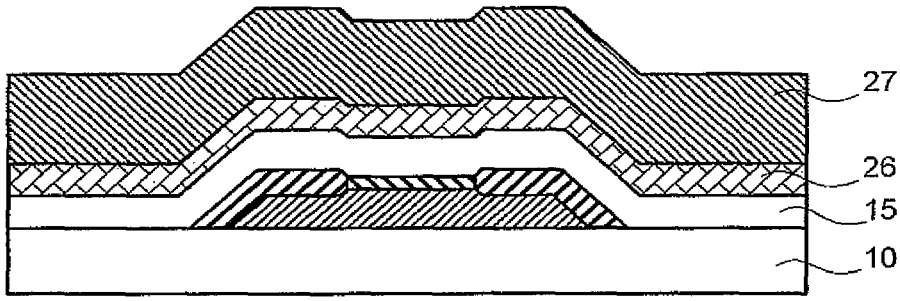
Figure 7C:
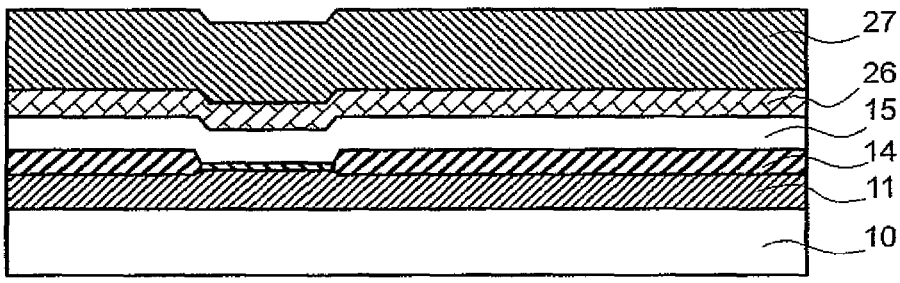
Figure 8A:
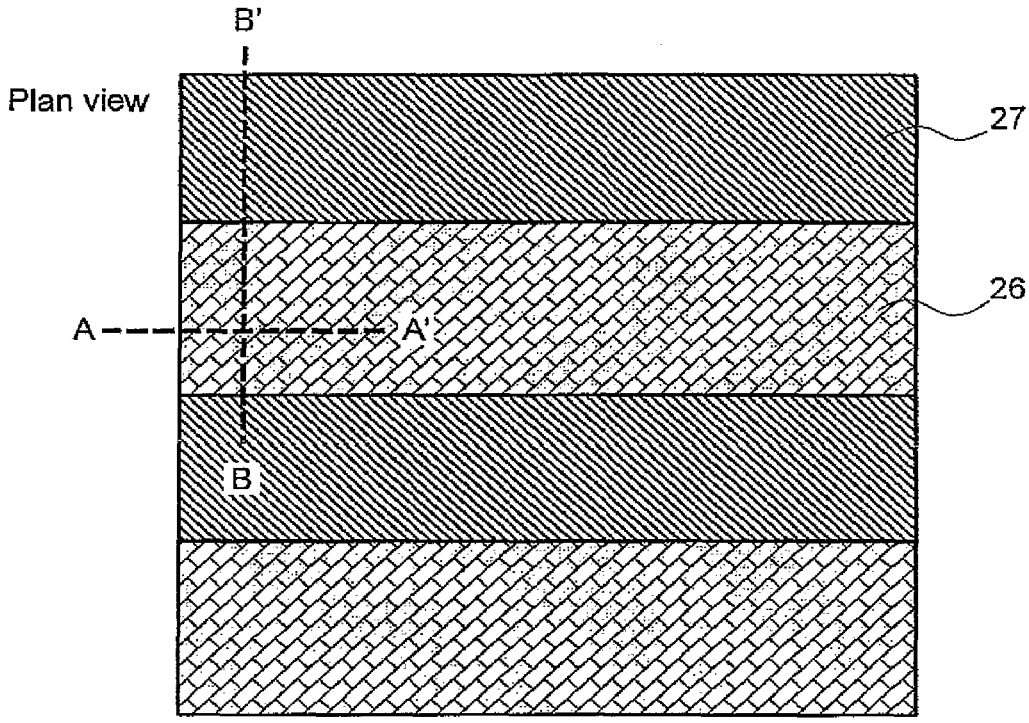
FIGS. 8A to 8C are diagrams showing the process (which follows the step shown in FIGS. 7A to 7C) for producing the thin-film electron source pertaining to the present invention.
Figure 8B:
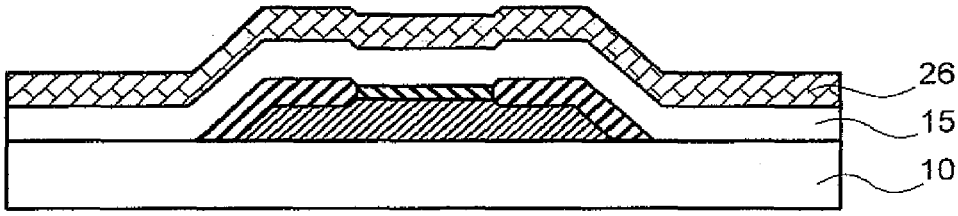
Figure 8C:
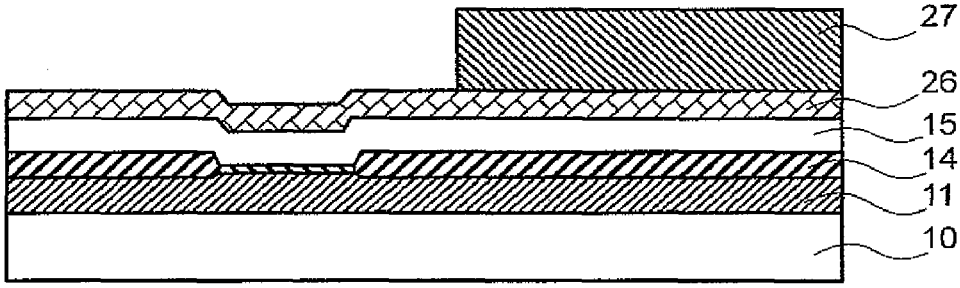
Figure 9A:
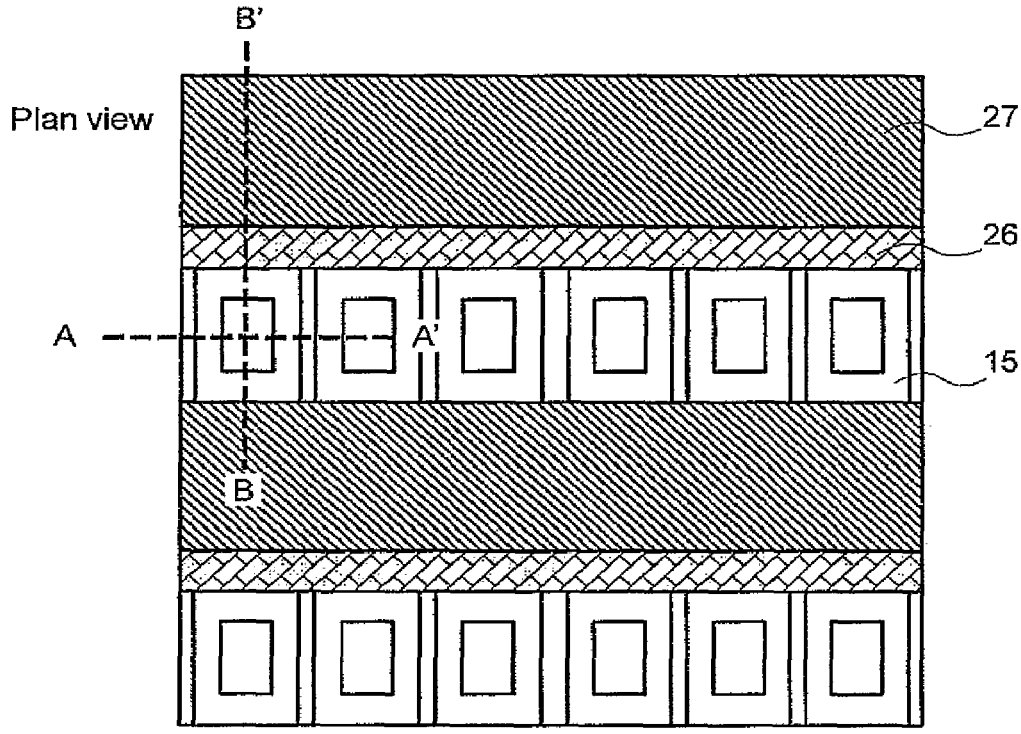
FIGS. 9A to 9C are diagrams showing the process (which follows the step shown in FIGS. 8A to 8C) for producing the thin-film electron source pertaining to the present invention.
Figure 9B:
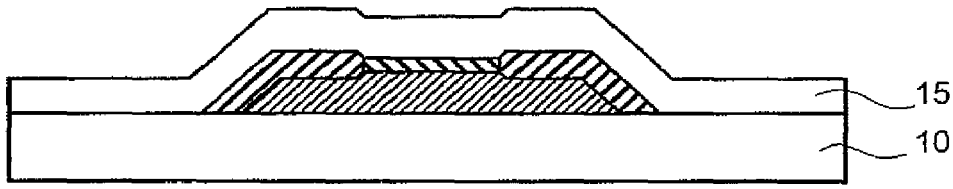
Figure 9C:
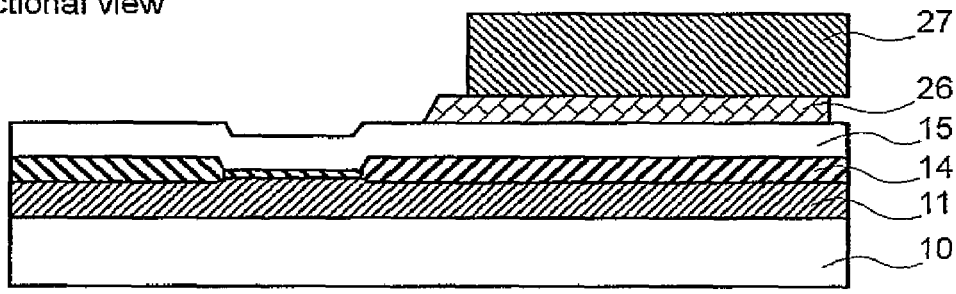

In the next step, sputtering is performed to sequentially form the interlayer insulating film (the second protective insulating film) 15, the first metal film (the upper buss electrode) 26, and the second metal film 27. (FIGS. 7A to 7C) The upper buss electrode 26 supplies power to the upper electrode 13. The interlayer insulating film 15 is a silicon nitride film, 100 nm thick. It fills pinholes in the protective insulating layer 14 formed by anodization, thereby ensuring insulation between the lower electrode 11 and the upper buss electrode 26. The upper buss electrode 26 is formed from chromium (Cr) and the second metal film 27 is formed from aluminum-neodynium (Al—Nd) alloy. The material for the upper buss electrode 26 may also be selected from molybdenum (Mo), tungsten (W), titanium (Ti), and niobium (Nb). The material for the second metal film 27 may also be selected from aluminum (Al), copper (Cu), chromium (Cr), and chromium alloy. The upper buss electrode 26 should be 10 nm in thickness and the second metal film 27 should be several micrometers in thickness.

Photoetching is performed in such a way that the upper buss electrode 26 and the second metal film 27 intersect the lower electrode 11 at right angles. The etchant of wet etching for the upper buss electrode 26 of chromium is an aqueous solution of ammonium cerium nitrate. The etchant of wet etching for the second metal film 27 of aluminum-neodynium (Al—Nd) alloy is an aqueous solution of phosphoric acid, acetic acid, and nitric acid mixed together. (FIGS. 8A to 8C and 9A to 9C)

Figure 10A:
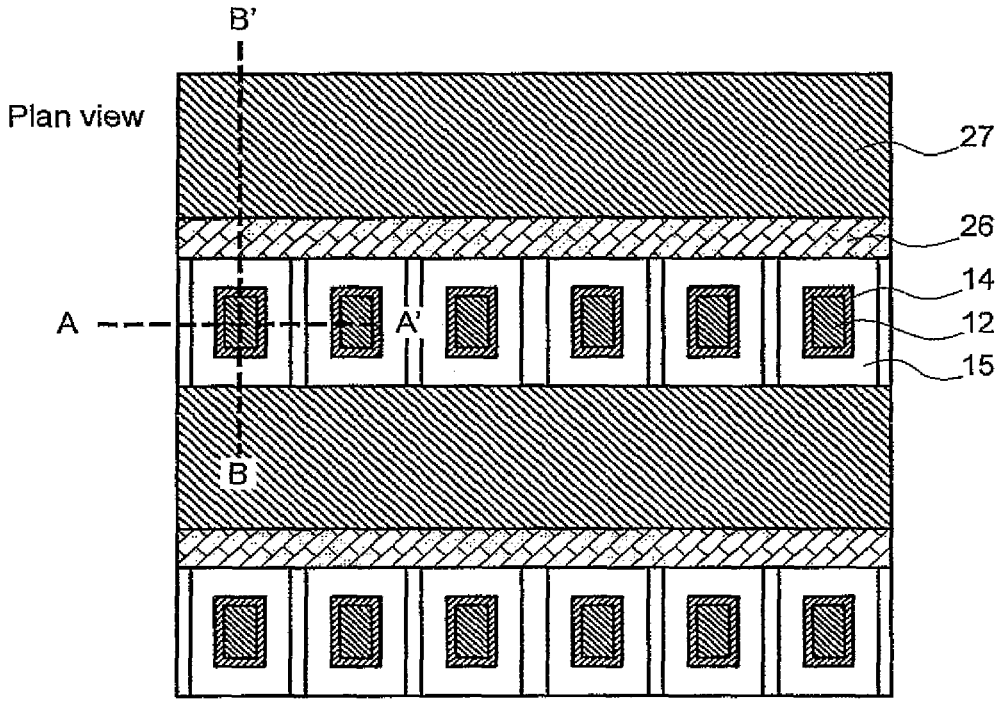
FIGS. 10A to 10C are diagrams showing the process (which follows the step shown in FIGS. 9A to 9C) for producing the thin-film electron source pertaining to the present invention.
Figure 10B:
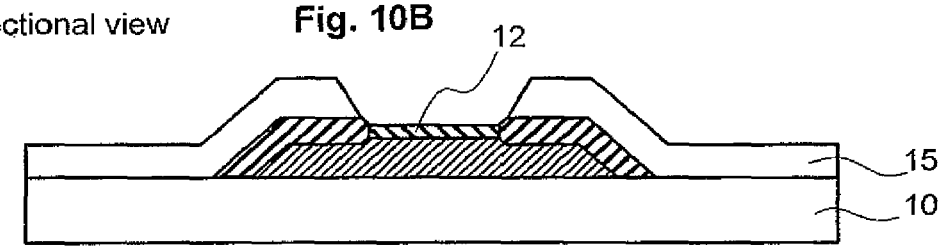
Figure 10C:
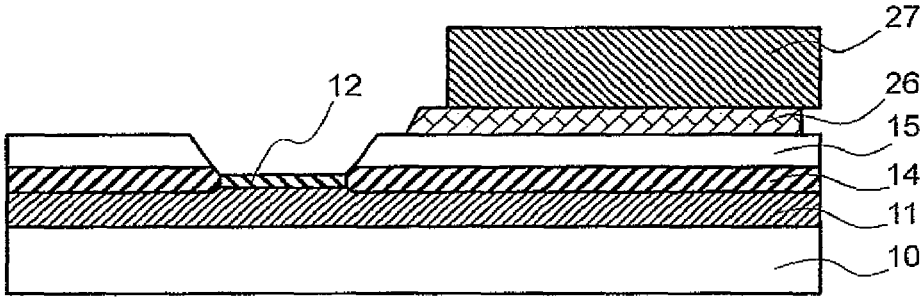
Figure 11A:
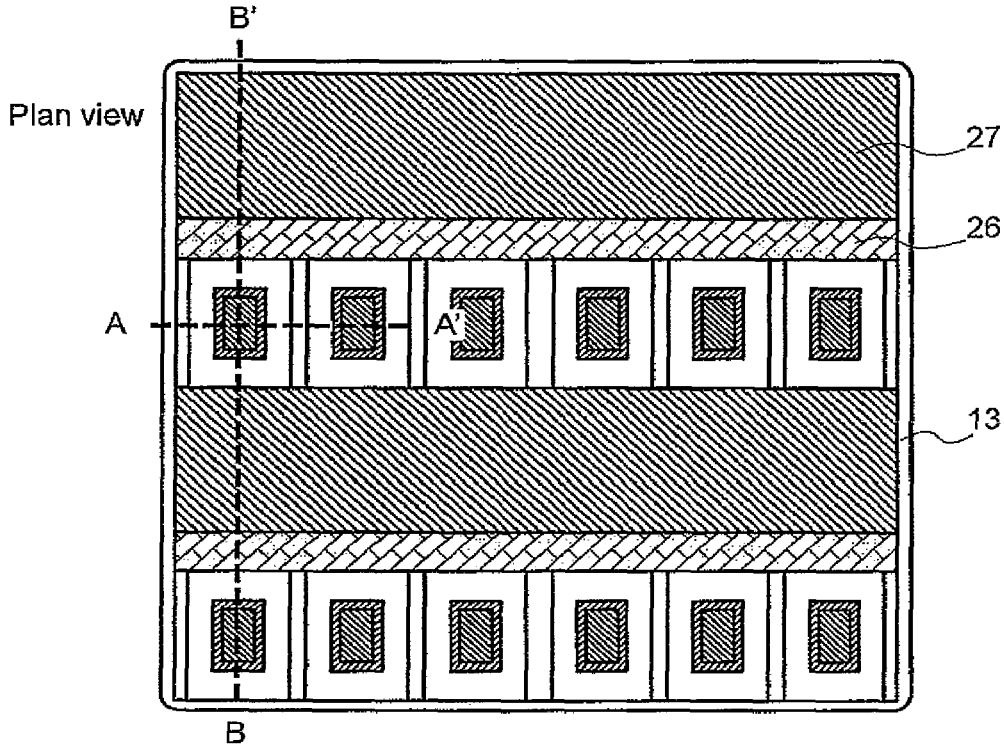
FIGS. 11A to 11C are diagrams showing the process (which follows the step shown in FIGS. 10A to 10C) for producing the thin-film electron source pertaining to the present invention.
Figure 11B:
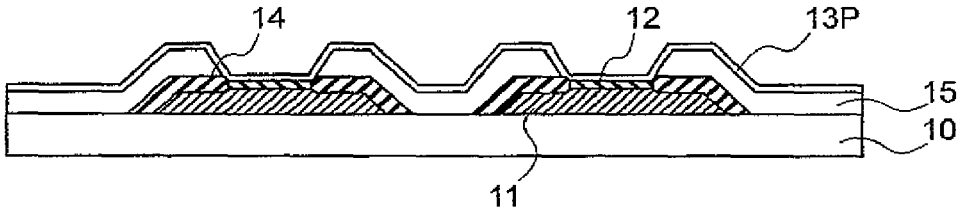
Figure 11C:
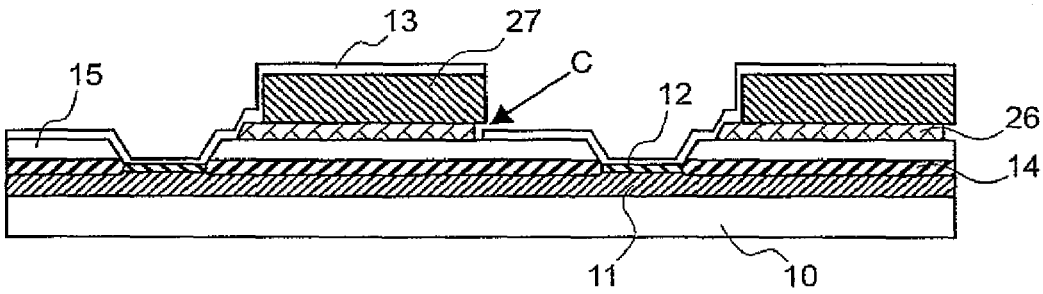

The interlayer insulating film 15 of SiN at the opening of the scan electrode 27 undergoes etching to open the electron emission part through which the electron accelerating layer 12 is exposed. This electron emission part is formed in part of the space of pixel held between one lower electrode 11 and two scan electrodes that intersect the lower electrode 11. This etching may be dry etching with an etchant composed mainly of $CF_4$ or $SF_6$. (FIGS. 10A to 10C)

Sputtering is performed to form the conductive thin film 13P for the upper electrode. The conductive thin film 13P is a laminate film (5 nm thick) composed of iridium (Ir), platinum (Pt), and gold (Au). The conductive thin film 13P becomes the upper electrode 13 after separation by self-alignment under the second metal film 27 formed by etching back at the side of the adjacent scan line of the upper buss electrode 26. The separated part is indicated by an arrow C in the B-B' sectional view in FIG. 11C. The upper electrode 13 is supplied with electric power through contact with the chromium film of the upper buss electrode 26 and the Al—Nd film of the second metal film 27.

The rear substrate prepared as mentioned above is attached to the front substrate, with spacers interposed between them, to complete the image display device (display panel).

Figure 12A:
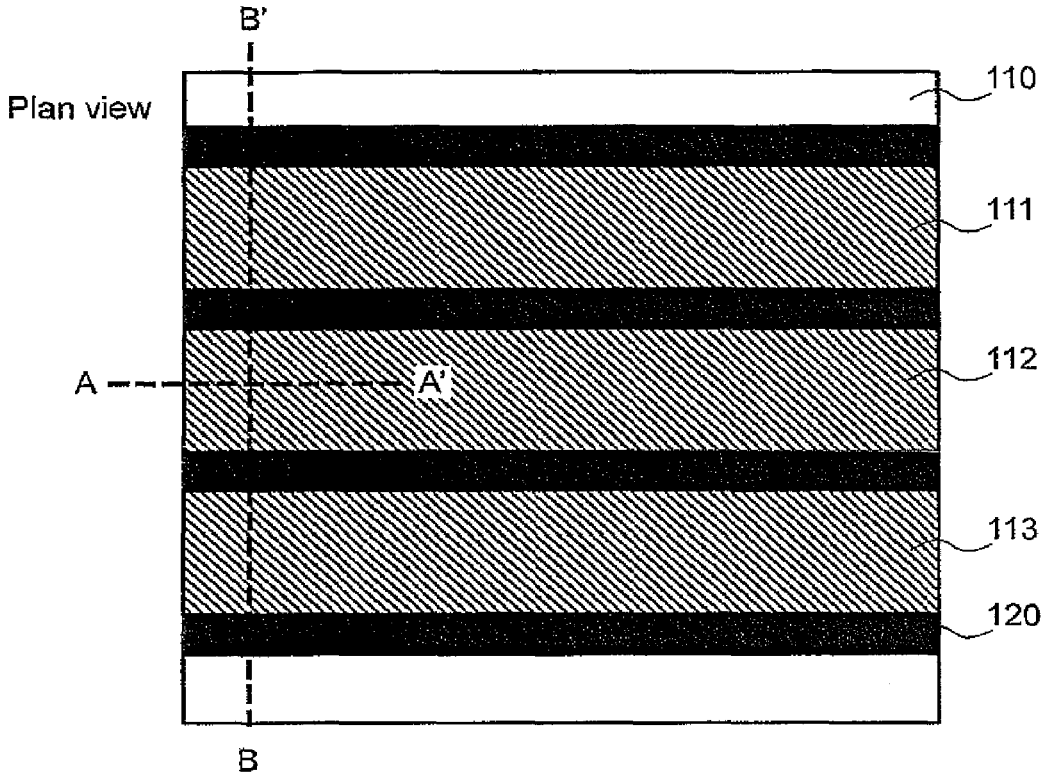
FIGS. 12A to 12C are diagrams illustrating the process of producing the front substrate.
Figure 12B:
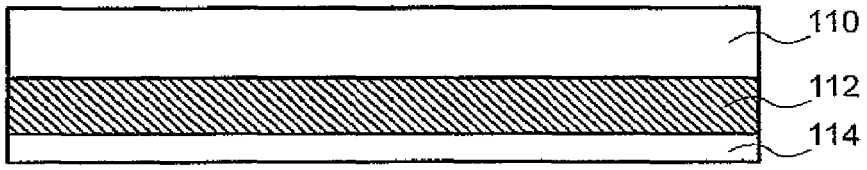
Figure 12C:
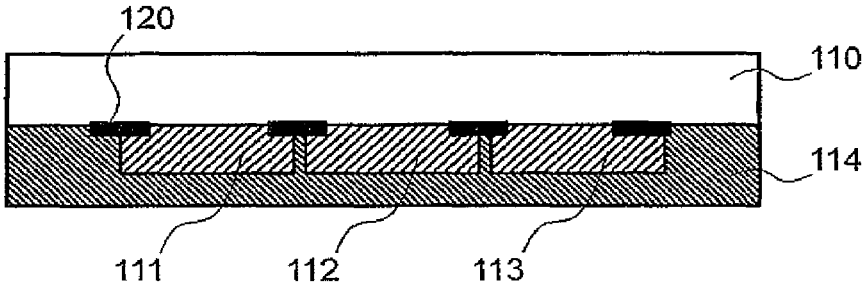

The front substrate is prepared by the process shown in FIGS. 12A to 12C. The insulating substrate 110 (which is preferably a glass plate) is coated with a solution of polyvinyl alcohol (PVA) and sodium dichromate to form the black matrix 120 which imparts a high contrast to the displayed image. The coating is irradiated with ultraviolet light (for sensitization) through a mask except for those parts which are to be left as the black matrix. With PVA removed from the unsensitized parts, the entire surface is coated with a black matrix solution containing graphite powder, followed by drying. The remaining PVA film with the coating of the black matrix solution is removed by lift off.

Then, phosphor layers (for three colors) are formed as follows. The insulating substrate 110 is coated with an aqueous solution containing red phosphor particles, PVA, and sodium dichromate, followed by drying. Those parts of the coating in which the red phosphor is to be formed are irradiated with ultraviolet light for sensitization, and the unsensitized parts are removed by flowing water. Thus, the pattern of the red phosphors 111 is formed. The same procedure as mentioned above is repeated to form the green phosphor 112 and the blue phosphors 113. In this example, the phosphors are formed in the stripy pattern as shown in FIGS. 12A to 12C. The phosphors are $Y_2O_2S$:Eu (P22-R) for red, ZnS:Cu,Al (P22-G) for green, and ZnS:Ag,Cl (P22-B) for blue.

The entire surface is covered with a nitrocellulose film and then coated with aluminum film (75 nm thick) by vapor deposition. The aluminum film is the metal back which functions as the accelerating electrode. The thus coated insulating substrate 110 is heated at about 400° C. in atmospheric air for thermal decomposition of organic matter (such as nitrocellulose and PVA). In this way the front substrate is completed.

Figure 13A:
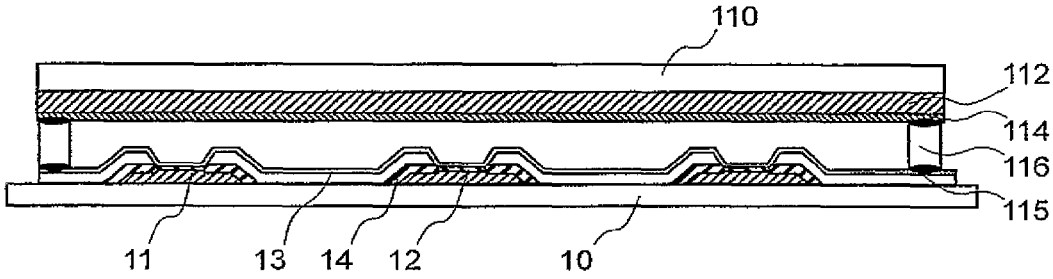
FIGS. 13A and 13B are sectional views (along lines A-A' and B-B') of the front substrate and the rear substrate which are combined together.
Figure 13B:
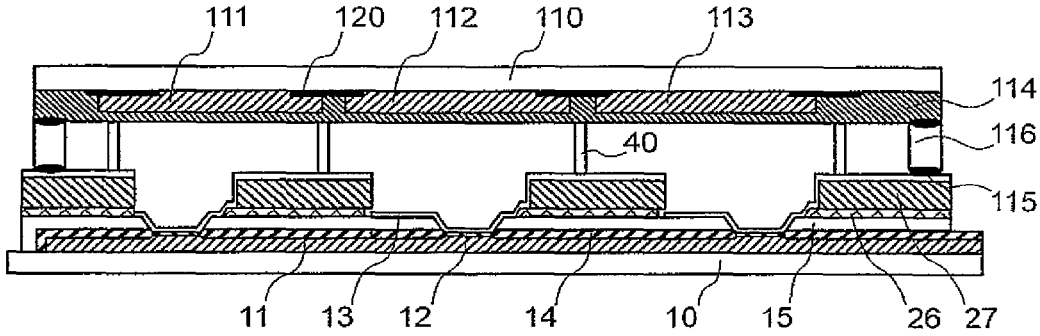

FIGS. 13A and 13B shows the cross sections along A-A' and B-B' of the front substrate 110 and the rear substrate 10, which are combined together with the spacer 40 interposed between them and with their periphery sealed by the shield frame 116 and frit glass 115. Sealing should preferably be carried out in atmospheric air to release the organic binder from the frit glass 115 and to reduce production cost involving equipment and labor for gas replacement.

Figure 14:
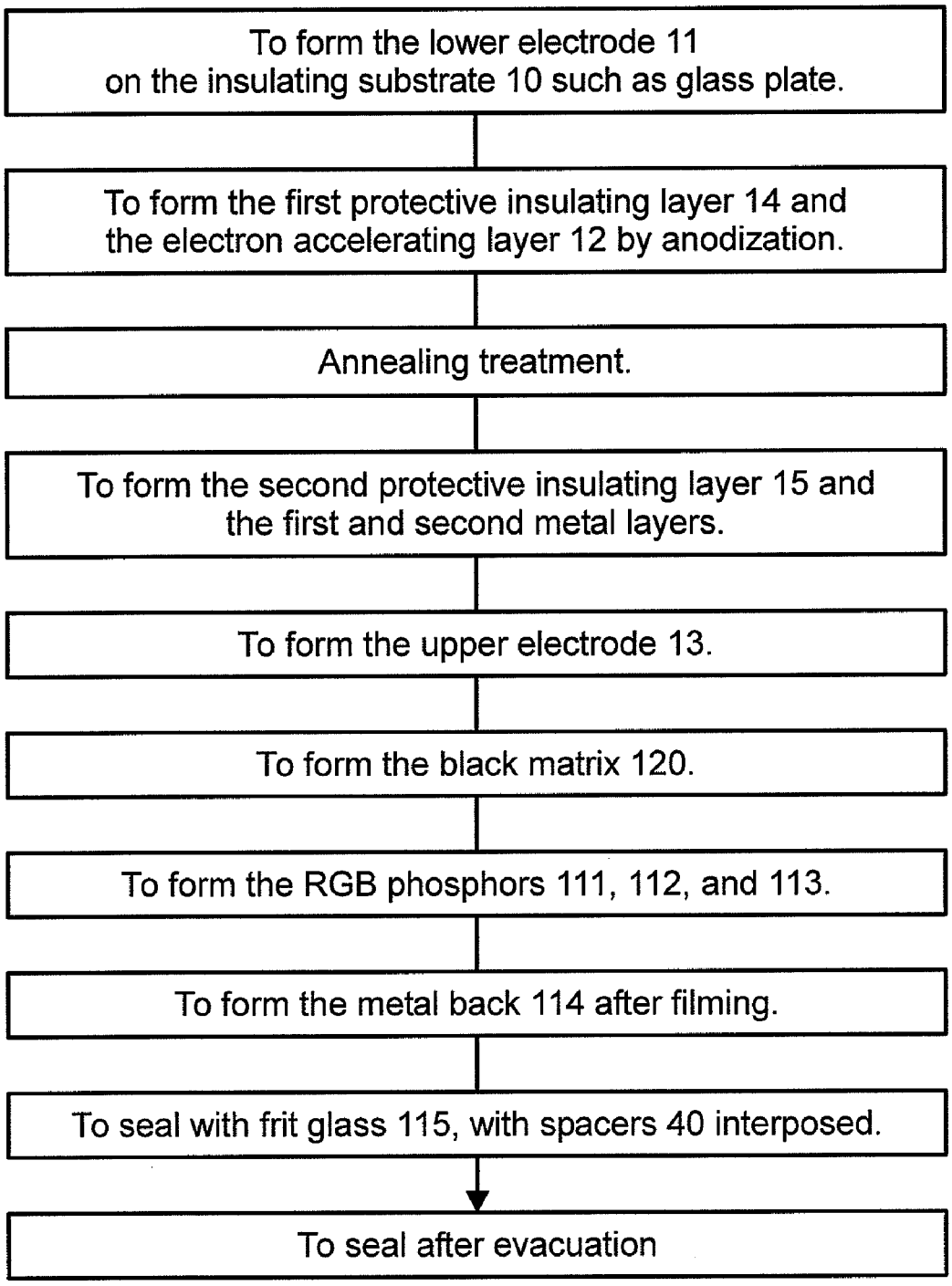
FIG. 14 is a diagram summarizing the steps of producing the image display device according to the present invention.
Figure 15:
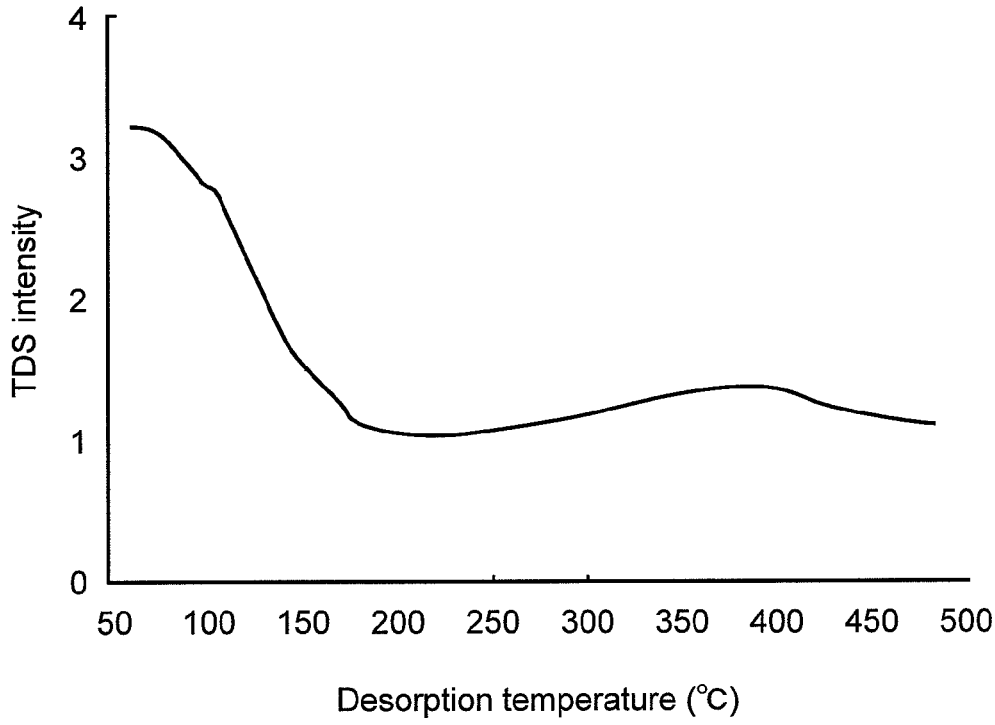
FIG. 15 is a diagram obtained from the thermal desorption spectrometry which was conducted to elucidate the temperature dependence of the amount of water desorbed from the anodized film pertaining to the example of the present invention.

The height of the spacer 40 is established so that the clearance between the front substrate 110 and the rear substrate 10 is about 1 to 5 mm, preferably about 1 to 3 mm. The spacers 40 shown in FIGS. 13A and 13B are placed on each scan line (the second metal film 27) for the sake of demonstration. In practice, the number of the spacers 40 may be reduced so long as the desired mechanical strength is secured. For example, the spacers 40 may be placed at intervals of 1 cm. The sealed space is kept at a vacuum of about $10^{-7}$ Torr. The foregoing steps are summarized in FIG. 14.

The desired degree of vacuum is maintained in the sealed space by activating the getter placed therein. The getter of evaporation type composed mainly of barium (Ba) is activated by high-frequency induction heating which forms a film on the getter. It is also possible to use a getter of non-evaporation type composed mainly of zirconium (Zr).

In this example, the clearance between the front substrate 110 and the rear substrate 10 is 1 to 3 mm, and the accelerating voltage applied to the metal back is 3 to 6 V. This structure permits the use of phosphor for cathode ray tubes.

FIGS. 5A to 5C are diagrams obtained from the thermal desorption spectrometry which was conducted to elucidate the temperature dependence of the amount of water desorbed from the anodized film pertaining to the example of the present invention. The abscissa represents the desorption temperature (or the heating temperature, ° C.), and the ordinate represents the intensity (in relative value) in TDS (thermal desorption spectroscopy). It is noted from FIGS. 5A to 5C that a large amount of water is desorbed at the heating temperature of 50 to 200° C. and water desorption continues to take place at temperatures above 200° C.

Figure 16:
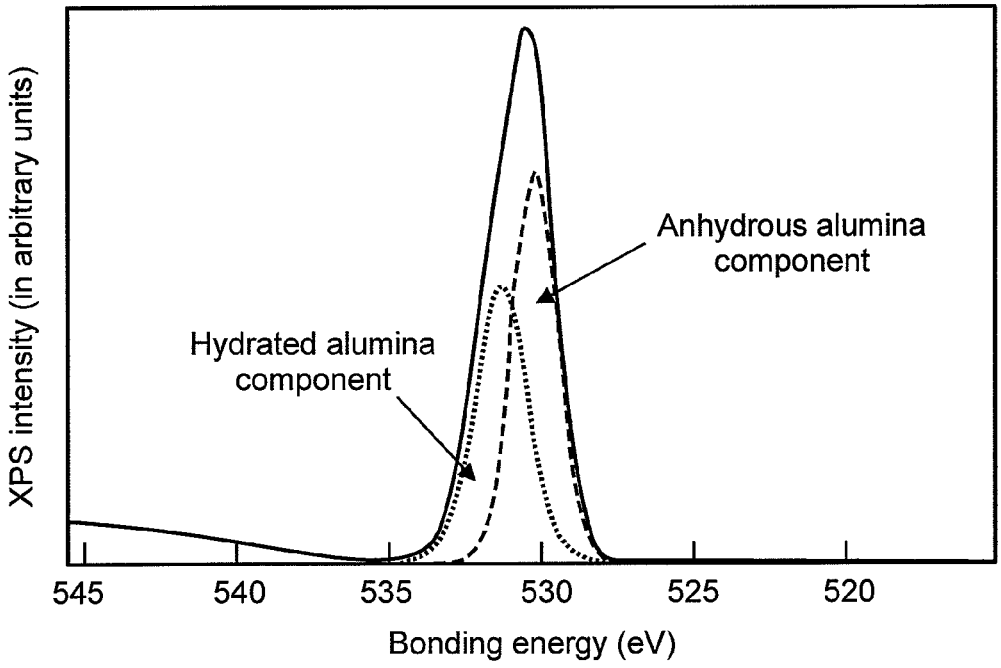
FIG. 16 is a diagram illustrating the result of XPS (X-ray photoelectron spectroscopy) which was conducted to determine the water content in the anodized film of aluminum.

FIG. 16 is a diagram illustrating the result of XPS (X-ray photoelectron spectroscopy) which was conducted to determine the water content in the anodized film of aluminum. The abscissa represents the atomic bond energy (eV) and the ordinate represents the intensity of XPS (in arbitrary unit). The result shown in FIG. 16 was obtained from a sample which was annealed at 100° C. XPS is intended to examine the bonding state around oxygen atoms (O 1s peak) in the alumina film which has just undergone anodization. Alumina is composed of hydrated alumina and anhydrous alumina. The XPS intensity of alumina, hydrated alumina, and anhydrous alumina is indicated respectively by the solid line, dotted line, and broken line. The bonding state is evaluated by separating hydrated alumina and anhydrous alumina from each other using the shift of bonding energy that occurs in XPS and then calculating the ratio of integrated intensity.

XPS is an analytical means sensitive to the surface of thin film. Incident X-rays penetrate to a depth of about 1 to 10 μm from the surface of a sample; however, photoelectrons are released only from the neighborhood of the surface because the excited electrons have a very small mean free path (several nanometers). Therefore, if a thin film about 10 nm in thickness (such as the one pertaining to this example) is to be analyzed entirely, it is necessary to perform physical etching (by sputtering with Ar) on the thin film and then examine the sample again by XPS.

The anodized film prepared in this example was analyzed in the depthwise direction. Four samples were prepared—one without Ar sputtering and three with Ar sputtering in different degrees—in consideration of the escape depth of photoelectron and the thickness of anodized film. Physical etching reaches a depth of about 2.5 nm each time. Therefore, the results of analyses provide the information of structure in each region of about 0 to 2.5 nm, 2.5 to 5 nm, 5.0 to 7.5 nm, and 7.5 to 10 nm in depth. In this example, the upper layer of the anodized film denotes the average value of measurements for the regions of 0 to 2.5 nm and 2.5 to 5 nm, and the lower layer of the anodized film denotes the average value of measurements for the regions of 5.0 to 7.5 nm and 7.5 to 10 nm. Thus, the upper layer and the lower layer each correspond to 50% of the total film thickness.

Figure 17:
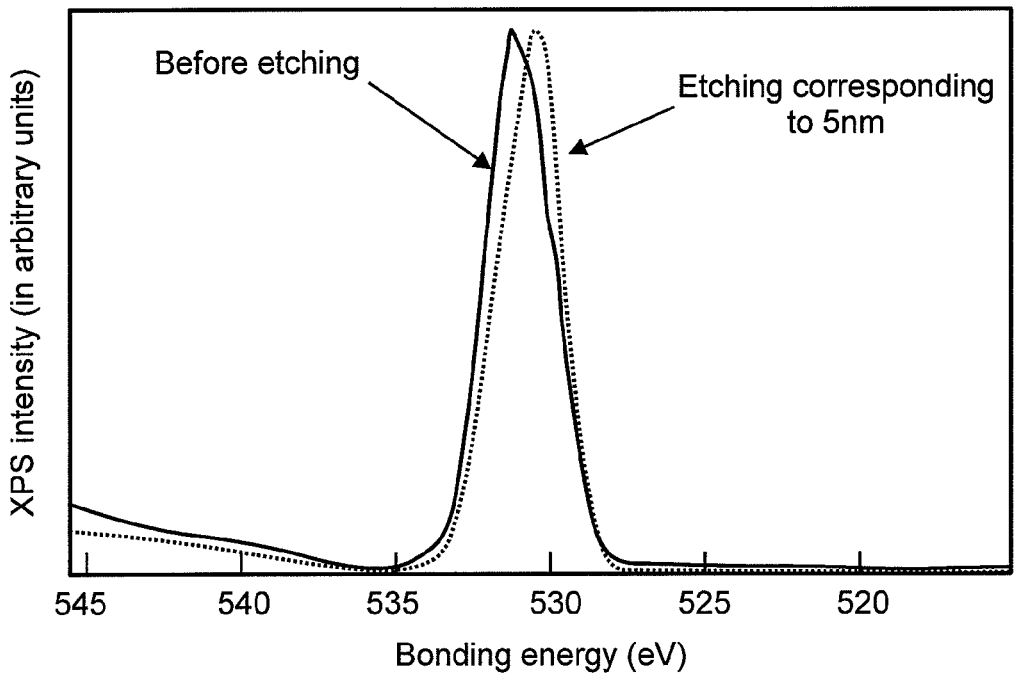
FIG. 17 is a diagram illustrating the result of XPS (X-ray photoelectron spectroscopy) which was conducted to determine the water content in the thickness direction in the anodized film of aluminum.

FIG. 17 is a diagram illustrating the result of XPS (X-ray photoelectron spectroscopy) which was conducted to determine the water content in the thickness direction in the anodized film of aluminum. As in FIG. 16, the abscissa represents the atomic bond energy (eV) and the ordinate represents the intensity of XPS (in arbitrary unit). The result shown in FIG. 17 was obtained from a sample which was annealed at 100° C. XPS is intended to examine the bonding state around oxygen atoms (O 1s peak) in the alumina film which has just undergone anodization. Alumina is composed of hydrated alumina and anhydrous alumina. The result shown in FIG. 17 was obtained before peak separation of the components. The solid line denotes the intensity before etching, and the broken line denotes the intensity after etching of 5 nm (corresponding to 50% of the total film thickness). As in FIG. 16, the bonding state is evaluated by separating hydrated alumina and anhydrous alumina from each other using the shift of bonding energy that occurs in XPS and then calculating the ratio of integrated intensity.

FIG. 18 is a diagram illustrating the effect of annealing temperature (for the anodized film) on the ratio of the amount of hydrated alumina to the total amount of hydrated alumina and anhydrous alumina in the alumina film. This result was obtained by the analyses shown in FIGS. 16 and 17. The analyses were carried out separately for the upper layer and the lower layer. It is noted from FIG. 18 that the ratio of hydrated alumina in the upper layer is larger than that in the lower layer. It is also noted that the ratio of hydrated alumina decreases in proportion to the annealing temperature.

It is hypothesized that the upper layer of the alumina film which comes into direct contact with the anodizing electrolyte at the time of anodization captures more water-containing electrolyte and this makes a difference in structure between the upper layer and the lower layer of the alumina film.

Figure 19:
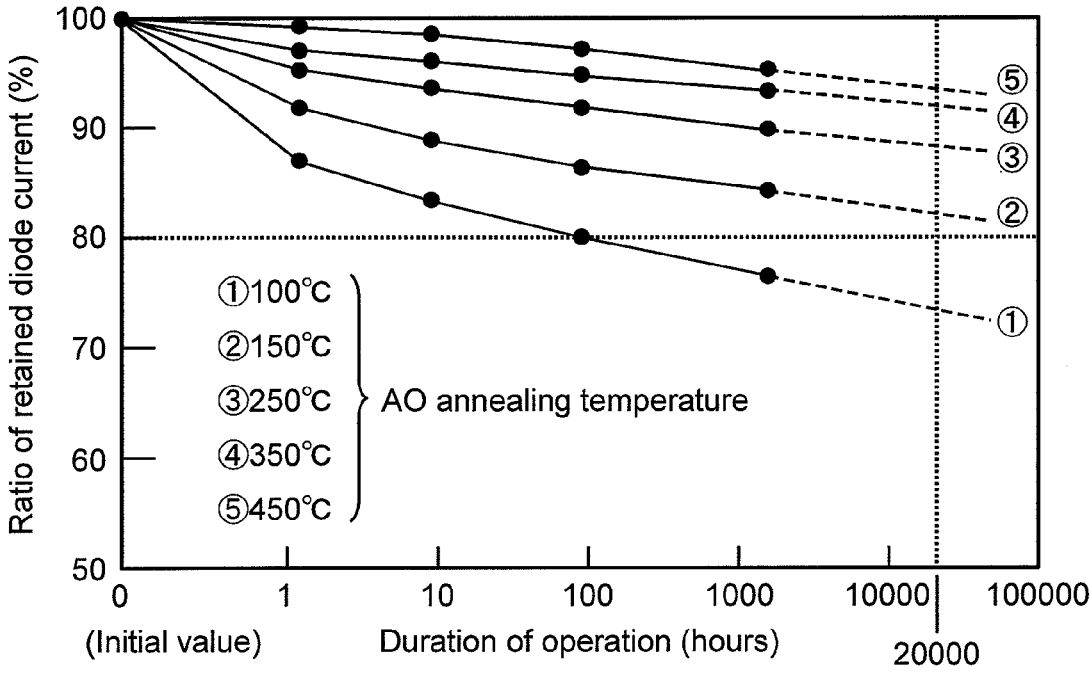
FIG. 19 is a diagram illustrating change with time in current flowing through MIM diodes prepared under different annealing conditions.

FIG. 19 is a diagram illustrating change with time in current flowing through MIM diodes prepared under different annealing conditions. The more the diode maintains the amount of current after a lapse of time, the better the diode is in its characteristic properties, because the brightness of the image display device is proportional to the amount of current flowing through the MIM diode. The MIM diode applied to the image display device is usually required to maintain a certain level of brightness even after operation for tens of thousands of hours. The MIM diode pertaining to this example is regarded as reliable if it maintains 80% of the initial diode current after operation for 20,000 hours. This condition is met by those MIM diodes which are annealed at temperatures in the range of 150° C. to 450° C.

Figure 20:
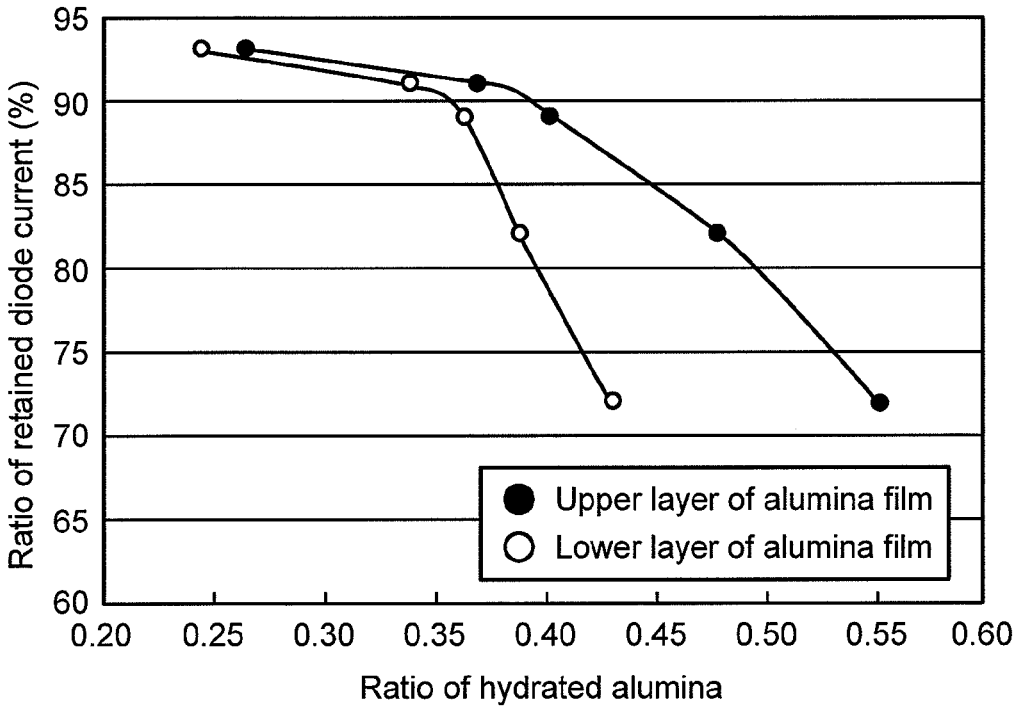
FIG. 20 is a diagram illustrating the relationship between the remaining diode current (in %), which is estimated by the result shown in FIG. 19, and the ratio of hydrated alumina in the upper and lower layers of the alumina film, which is calculated from the result shown in FIG. 18.

FIG. 20 is a diagram illustrating the relationship between the remaining diode current (in %), which is estimated by the result shown in FIG. 19, and the ratio of hydrated alumina in the alumina film, which is calculated from the result shown in FIG. 18. The remaining diode current (in %) is defined by [the diode current after operation for a certain period of time] divided by [the initial diode current]. In this example, it was calculated after operation for 20,000 hours. It is noted from FIG. 20 that the upper layer (close to the upper electrode) of the alumina film (anodized film) contains more hydrated alumina than the lower layer (or the ratio of hydrated alumina is 0.26-0.45 in the upper layer and 0.24-0.38 in the lower layer). Therefore, the MIM diode maintains more than 80% of its initial diode current and it contributes to the image display device with high reliability.

While we have shown and described several embodiments in accordance with the present invention, it is understood that the same is not limited thereto but is susceptible of numerous changes and modifications as known to those skilled in the art, and we therefore do not wish to be limited to the details shown and described herein but to cover all such changes and modifications as are encompassed by the scope of the appended claims.

What is claimed is:

1. An image display device which comprises a first substrate and a second substrate facing each other, said first substrate having within the region of image display an array of thin-film electron sources having a large number of electron emitting parts arranged in a two-dimensional matrix, said array being composed of a large number of mutually parallel signal wires of aluminum formed on the inside and a large number of mutually parallel scan wires which intersect said signal wires on said signal wires with an interlayer insulating film interposed between them, said electron emitting parts being formed near the intersections of said signal wires and said scan wires, said second substrate having on its inside facing said first substrate a fluorescent plane composed of a plurality of phosphors that emit light upon excitation by electrons released from said array of thin-film electron sources, said thin-film electrons sources being constructed of lower electrodes, which are said signal wires, electron accelerating layers of anodized film, which are formed by anodizing the surface of said signal wires, and upper electrodes, which cover said electron accelerating layers and function as the electron emitting electrodes, said anodized film constituting said electron accelerating layer contains therein a hydrated alumina component and an anhydrous alumina component, with the ratio of said hydrated alumina component to the total amount of said hydrated alumina component and anhydrous alumina component varying from one position to another in said electron accelerating layer such that said ratio in the position close to said upper electrode is greater than said ratio in the position close to the lower electrode.

2. The image display device as defined in claim 1, wherein said electron accelerating layer is constructed such that that part of said anodized film which corresponds to about 50% (from said upper electrode) of the total thickness contains said hydrated alumina component and said anhydrous alumina component, with the ratio of the amount of said hydrated alumina component to the total amount of said hydrated alumina component and said anhydrous alumina component being in the range of 0.26 to 0.45, and such that that part of said anodized film which corresponds to about 50% (from said lower electrode) of the total thickness contains said hydrated alumina component and said anhydrous alumina component, with the ratio of the amount of said hydrated alumina component to the total amount of said hydrated alumina component and said anhydrous alumina component being in the range of 0.24 to 0.38.

3. The image display device as defined in claim 2, wherein the anodized film constituting said electron accelerating layer has a thickness of 5 to 15 nm.

4. The image display device as defined in claim 1, wherein said electrode constituting the electron emitting electrode of aid thin-film electron source is characterized in that the electrically conductive film electrically connected to said scan wires which are so formed as to cover the entire surface of said image display region on the upper layer of said scan wires, is electrically separated from adjacent scan wires.

5. The image display device as defined in claim 1, wherein each of said thin-film electron sources is arranged at one side in the widthwise direction of said scan wire.

6. The image display device as defined in claim 4, wherein said thin-film electron sources are formed on the anodized film constituting said electron accelerating layer arranged in the opening of the interlayer insulating layer that insulates said signal wires and said scan wires from each other, with said electrically conductive thin film functioning as said electron emitting electrode.

7. The image display device as defined in claim 1, wherein said first substrate and said second substrate are held apart with a clearance regulated by spacers which are arranged at the side in the widthwise direction of said scan wire away from said electron emitting part.

8. The image display device as defined in claim 1, wherein said scan wire is mad of pure aluminum or aluminum alloy and said upper electrode is made of one noble metal or two or more noble metals laminated one over another.

9. The image display device as defined in claim 8, wherein said aluminum alloy is aluminum-neodymium alloy.

10. The image display device as defined in claim 8, wherein said noble metal is any one of iridium, platinum, and gold.

* * * * *